US008128379B2

(12) United States Patent
Hritz

(10) Patent No.: US 8,128,379 B2
(45) Date of Patent: Mar. 6, 2012

(54) TEMPERATURE MANAGEMENT SYSTEM FOR A 2CD TYPE AIR COMPRESSOR

(75) Inventor: Jeffrey J. Hritz, Baldwin, PA (US)

(73) Assignee: Wabtec Holding Corp., Wilmerding, PA (US)

( * ) Notice: Subject to any disclaimer, the term of this patent is extended or adjusted under 35 U.S.C. 154(b) by 719 days.

(21) Appl. No.: 12/273,664

(22) Filed: Nov. 19, 2008

(65) Prior Publication Data

US 2010/0122808 A1 May 20, 2010

(51) Int. Cl.
*F04B 39/06* (2006.01)

(52) U.S. Cl. ..... 417/228; 417/164; 417/366; 165/287

(58) Field of Classification Search ..... 417/164, 417/228, 366, 32; 165/287
See application file for complete search history.

(56) References Cited

U.S. PATENT DOCUMENTS 3,441,200 A * 4/1969 Huesgen ..... 417/53
4,362,462 A 12/1982 Blotenberg
4,443,156 A 4/1984 Dunnam, Jr.
4,570,849 A 2/1986 Klaucke et al.
4,830,580 A 5/1989 Hata et al.
5,072,597 A * 12/1991 Bromley et al. ..... 62/209
5,106,270 A 4/1992 Goettel et al.
5,284,202 A 2/1994 Dickey et al.
5,639,224 A 6/1997 Schlossarczyk et al.
5,718,563 A 2/1998 Hutchinson
5,885,060 A 3/1999 Cunkelman et al.
5,894,881 A 4/1999 Wagner et al.
5,927,399 A 7/1999 Kazakis et al.
5,947,711 A 9/1999 Myers et al.
6,022,200 A 2/2000 Myers
6,026,587 A 2/2000 Cunkelman et al.
6,056,510 A * 5/2000 Miura et al. ..... 417/2
6,062,825 A 5/2000 Chovan
6,102,665 A * 8/2000 Centers et al. ..... 417/18
6,167,956 B1 1/2001 Bostedo et al.
6,220,825 B1 4/2001 Myers et al.
6,390,779 B1 5/2002 Cunkelman
6,474,950 B1 11/2002 Waldo
6,499,960 B2 12/2002 Chen
6,638,029 B2 10/2003 Kharsa
6,659,739 B2 12/2003 Varney et al.
6,799,950 B2 10/2004 Meier et al.
7,059,279 B2 6/2006 Bystedt et al.
7,841,837 B2 * 11/2010 Chen ..... 417/14
2001/0024615 A1 9/2001 Chen
2006/0275145 A1 12/2006 Takahashi et al.
2009/0087320 A1 * 4/2009 Tanaka et al. ..... 417/228

OTHER PUBLICATIONS

WABTEC Corporation, "3-CD Type Air Compressors, Exhausters and Combination Compressor-Exhausters", Operation & Maintenance Information, pp. 1-54, Feb. 2004.

* cited by examiner

*Primary Examiner* — Peter Macchiarolo
(74) *Attorney, Agent, or Firm* — The Webb Law Firm

(57) ABSTRACT

A temperature management system for an air compressor includes a plurality of cooling fans coupled to an intercooler of the air compressor; an electrical relay comprising a coil and contacts operated by the coil; and a temperature switch coupled to the coil of the electrical relay. The contacts are located between the cooling fans and an electrical power supply. The temperature switch opens at a temperature above a predetermined temperature at a high pressure inlet of a high pressure stage of the air compressor, thereby closing the contacts of the electrical relay which applies power to the cooling fans.

18 Claims, 4 Drawing Sheets

TEMPERATURE MANAGEMENT SYSTEM FOR A 2CD TYPE AIR COMPRESSOR

BACKGROUND OF THE INVENTION

1. Field of the Invention

The present invention relates generally to air compressors used on locomotives to supply pressurized air to the brakes of the locomotives and all other pneumatic systems on the locomotive and, more particularly, to a temperature management system for an air compressor to maintain the compressor at a controlled temperature during operation.

2. Description of Related Art

Air compressors are used on freight, passenger, and switcher locomotives for supplying compressed air to the locomotive, train brake operation, and all other pneumatic systems on the locomotive. Due to the operating nature of a multiple stage compressor with inter-stage cooling, the internal temperatures of the compressor must be held high enough to avoid the internal condensation of water. On the other hand, too little cooling will cause the compressor to be less efficient and in the extreme case, will lead to compressor failure. In order to maintain a proper operating temperature, air compressors are typically located directly beneath the locomotive radiator fans for overheating protection and minimum compressor operating temperatures are maintained by never turning the compressor off when in use. In other words, current air compressors are typically operated in a load/unload method of operation. However, positioning air compressors directly beneath the locomotive radiator fan is not always an ideal location for the air compressor. In addition, since the air compressor is never turned off, power is unnecessarily wasted.

In addition, systems and control circuits are known for controlling the operation of a fan-cooled aftercooler receiving pressurized air from a compressor located in a locomotive. For instance, U.S. Pat. No. 5,894,881 to Wagner et al. discloses such a control circuit. However, the system disclosed in this patent is provided to prevent the aftercooler from pulling ambient air past finned heat exchanger tubes receiving compressed air from the compressor when the ambient temperature is at or below freezing. Such a system is not used to manage the temperature of the compressor and, therefore, does not allow the repositioning of a compressor in any suitable location in the locomotive.

Accordingly, a need exists for an air compressor utilizing an independent temperature management system, thereby removing the need for mounting the air compressor directly in the proximity of the locomotive radiator or other cooling fans. A further need exists for an air compressor that has a system for removing the need for mounting the air compressor directly hi the proximity of the locomotive radiator or other cooling fans.

SUMMARY OF THE INVENTION

An object of the present invention is to provide an air compressor that does not require external cooling fans, thereby removing the need for mounting the air compressor directly in the proximity of the locomotive radiator or other cooling fans. A further object of the present invention is to provide an air compressor that has a system thereby removing the need for mounting the air compressor directly in the proximity of the locomotive radiator or other cooling fans. The temperature management system of the present invention has been designed to maintain the compressor at a controlled temperature during operation. This temperature must be cool enough to avoid component overheating and warm enough to avoid condensation of water within an intercooler of the compressor. Such conditions can lead to premature wear of compressor components and premature failure of the compressor.

Accordingly, the present invention is directed to a temperature management system for an air compressor. The temperature management system includes a plurality of cooling fans coupled to an intercooler of the air compressor; an electrical relay comprising a coil and contacts operated by the coil; and a temperature switch coupled to the coil of the electrical relay. The contacts are located between the cooling fans and an electrical power supply. The temperature switch opens at a temperature above a predetermined temperature at a high pressure inlet of a high pressure stage of the air compressor, thereby closing the contacts of the electrical relay which applies power to the cooling fans.

The cooling fans may include a first cooling fan and a second cooling fan. The first cooling fan and the second cooling fan may be electrically coupled in parallel. The temperature switch may be located in series with the coil of the electrical relay. The air compressor may be a 2CD type air compressor.

The temperature switch may be closed when the temperature at the high pressure inlet falls below a second predetermined temperature, thereby opening the contacts of the electrical relay and removing power supplied to the cooling fans. The predetermined temperature may be about 200° F., and the second predetermined temperature may be about 190° F. The temperature switch may be positioned at the high pressure inlet of the high pressure stage of the inlet. Failure of the temperature switch may cause the contacts of the relay to close, thereby applying power to the cooling fans.

The present invention is also an electrical circuit for controlling a plurality of cooling fans coupled to an intercooler of an air compressor. The electrical circuit includes a load circuit and a switching circuit. The load circuit includes the plurality of cooling fans and contacts of an electrical relay located between the cooling fans and an electrical power supply. The switching circuit includes a temperature switch and a coil of the electrical relay coupled with the temperature switch. The temperature switch opens at a predetermined temperature at a high pressure inlet of a high pressure stage of the air compressor, thereby closing the contacts of the electrical relay which applies power to the cooling fans.

The cooling fans may include a first cooling fan and a second cooling fan. The first cooling fan and the second cooling fan may be electrically coupled in parallel. The temperature switch may be located in series with the coil of the electrical relay. The air compressor may be a 2CD type air compressor. The predetermined temperature may be about 200° F.

In addition, the present invention is directed to a method of installing an air compressor on a locomotive. The method includes the steps of providing an air compressor having a temperature management system and mounting the air compressor with the temperature management system at a location remote from a radiator of the locomotive. The temperature management system includes a plurality of cooling fans coupled to an intercooler of the air compressor; an electrical relay comprising a coil and contacts operated by the coil; and a temperature switch coupled with the coil of the electrical relay. The contacts are located between the cooling fans and an electrical power supply. The temperature switch opens at a temperature above a predetermined temperature, thereby closing the contacts of the electrical relay which applies power to the cooling fans.

The temperature switch may be closed when the temperature at the high pressure inlet falls below a second predetermined temperature, thereby opening the contacts of the electrical relay and removing power supplied to the parallel first cooling fan and second cooling fan. The predetermined temperature is about 200° F., and the second predetermined temperature is about 190° F. Failure of the temperature switch may cause the contacts of the relay to close, thereby applying power to the cooling fans.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an" and "the" include plural referents unless the context clearly dictates otherwise.

DETAILED DESCRIPTION OF THE PRESENT INVENTION

Figure 1:
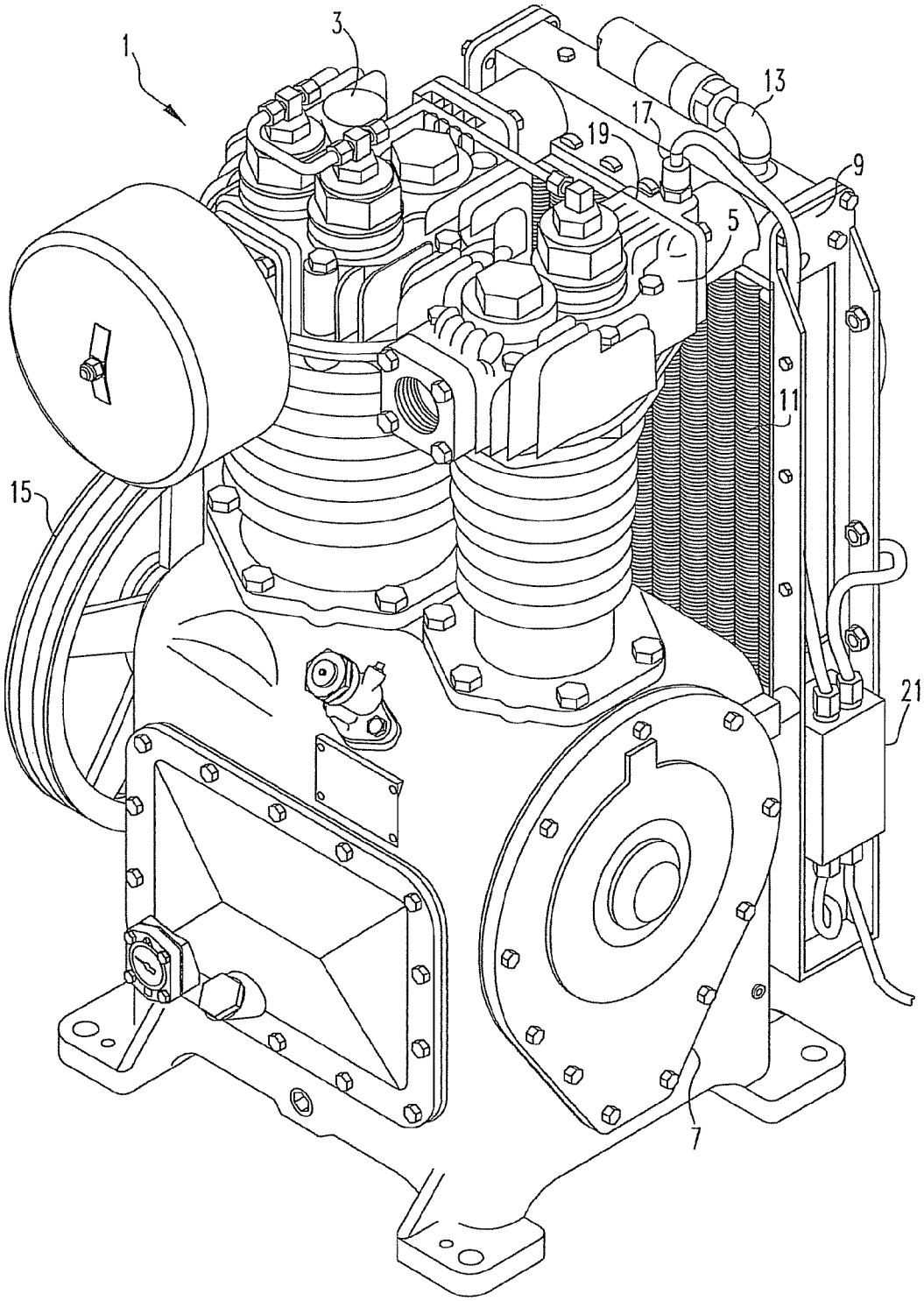
FIG. 1 is a perspective view of an air compressor having a temperature management system in accordance with one embodiment described herein.

For purposes of the description hereinafter, the spatial orientation terms and derivatives thereof shall relate to the embodiment as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments. Hence, specific dimensions and other physical characteristics related to the embodiments disclosed herein are not to be considered as limiting.

Figure 2:
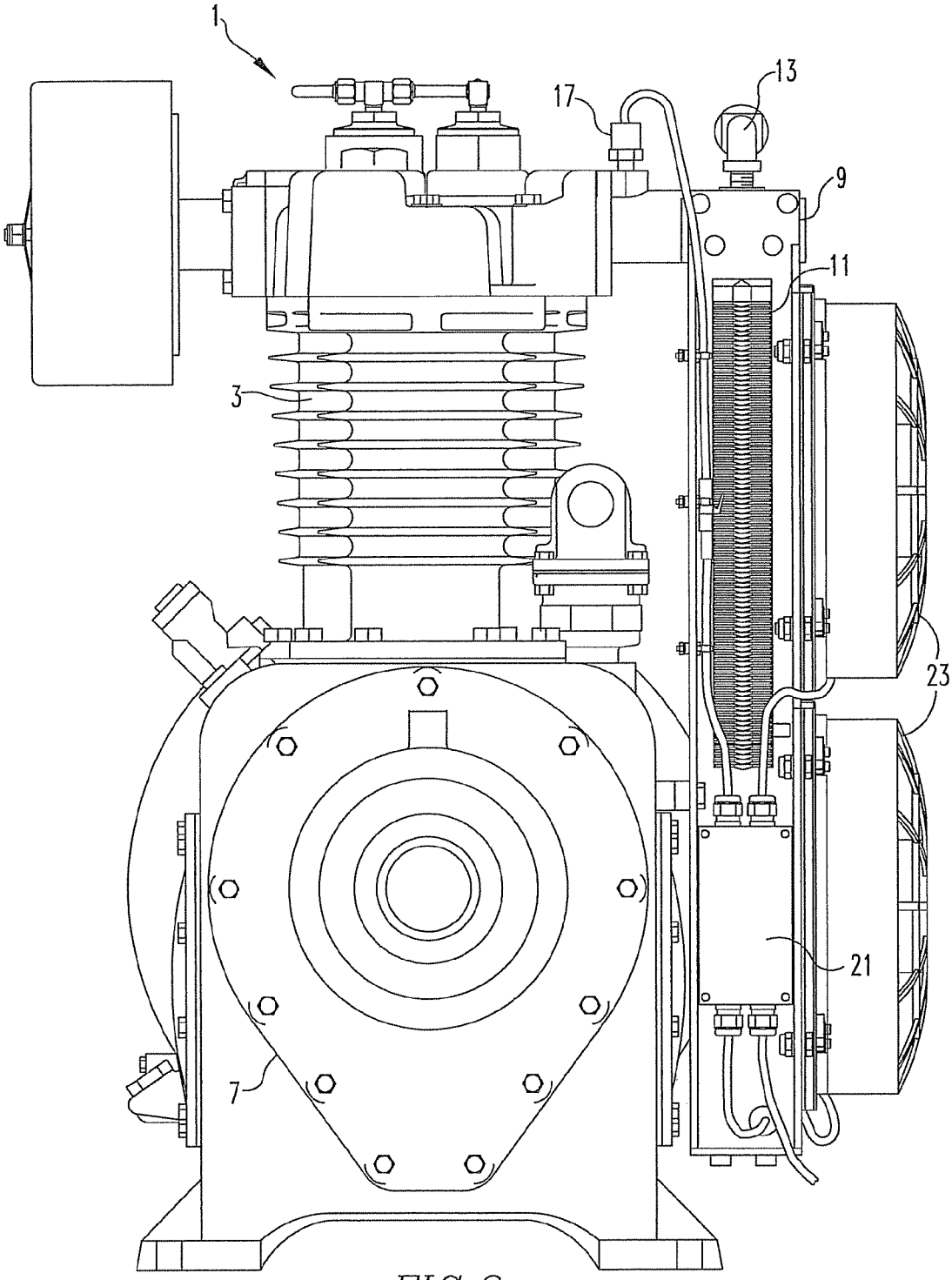
FIG. 2 is a front view of the air compressor of FIG. 1.
Figure 3:
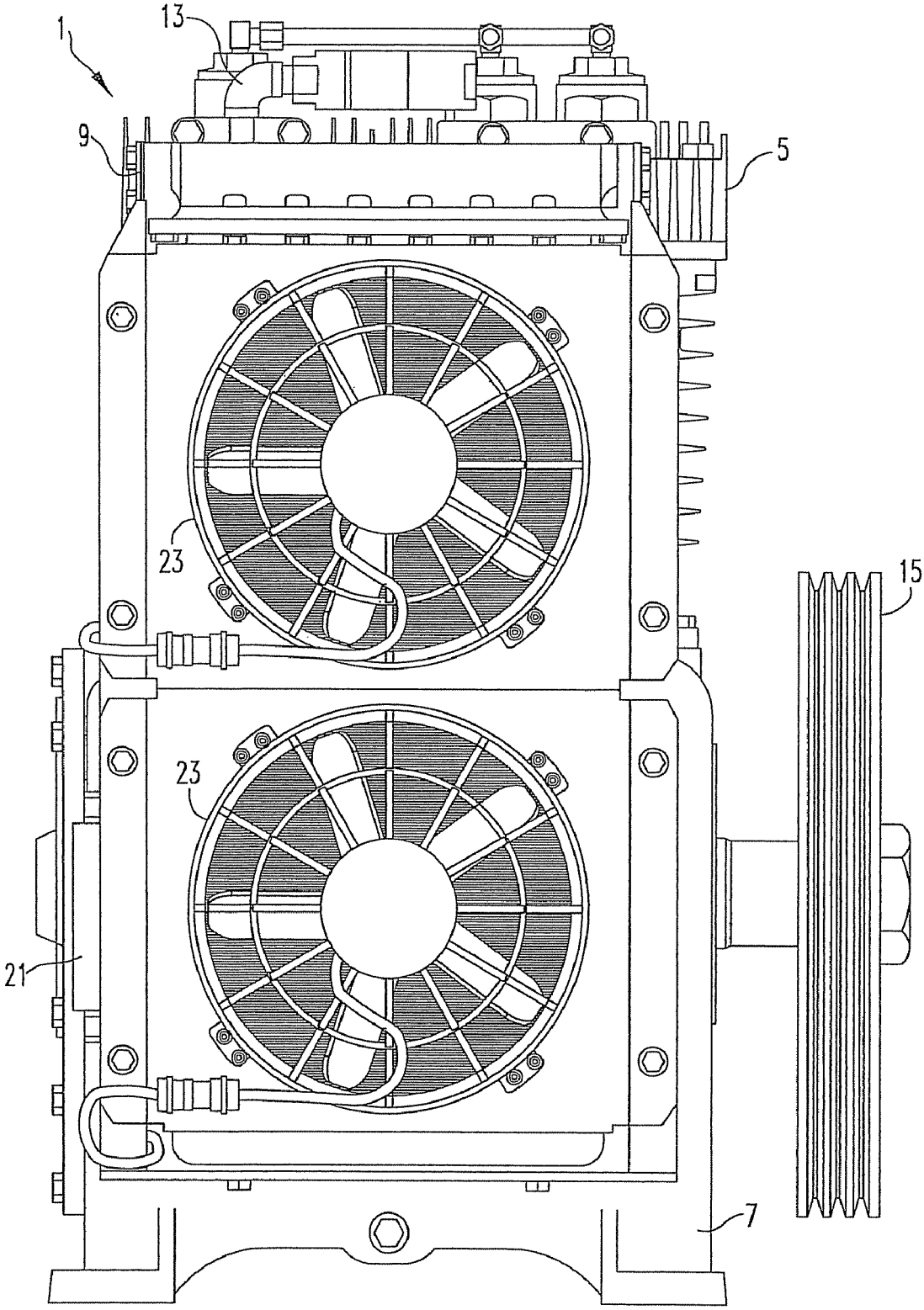
FIG. 3 is a side view of the air compressor of FIG. 2.

A temperature management system as described herein has applications for use with a 2CD type air compressor, as manufactured by Wabtec Corporation, to maintain the compressor at a controlled temperature during operation. With reference to FIGS. 1 through 3, a 2CD type air compressor 1 includes a low pressure stage 3, a high pressure stage 5 and a compressor crankcase 7. Air compressor 1 also includes an intercooler 9 mounted to crankcase 7. Intercooler 9 is configured to cool the air between low pressure stage 3 and high pressure stage 5. Intercooler 9 is constructed from a plurality of copper or aluminum finned tubes 11. A relief valve 13 is mounted on intercooler 9 for the purpose of limiting pressure build-up in intercooler 9. Compressor 1 may be driven directly off the locomotive's diesel engine through appropriate couplings and a drive shaft or it may be belt driven by an electric motor (not shown) operatively coupled to a drive pulley 15.

The temperature management system is intended to maintain high pressure stage inlet air at a proper operating temperature. This temperature is desirably cool enough to avoid component overheating and warn enough to avoid condensation of water within the intercooler. Both conditions can lead to premature wear and failure. The temperature management system includes a temperature switch 17 positioned at a high pressure stage inlet 19 of high pressure stage 5. Additional control circuitry, as will be discussed in greater detail hereinafter, is positioned within an electrical enclosure 21 and a pair of cooling fans 23, electrically coupled in parallel, coupled to intercooler 9.

Figure 4:
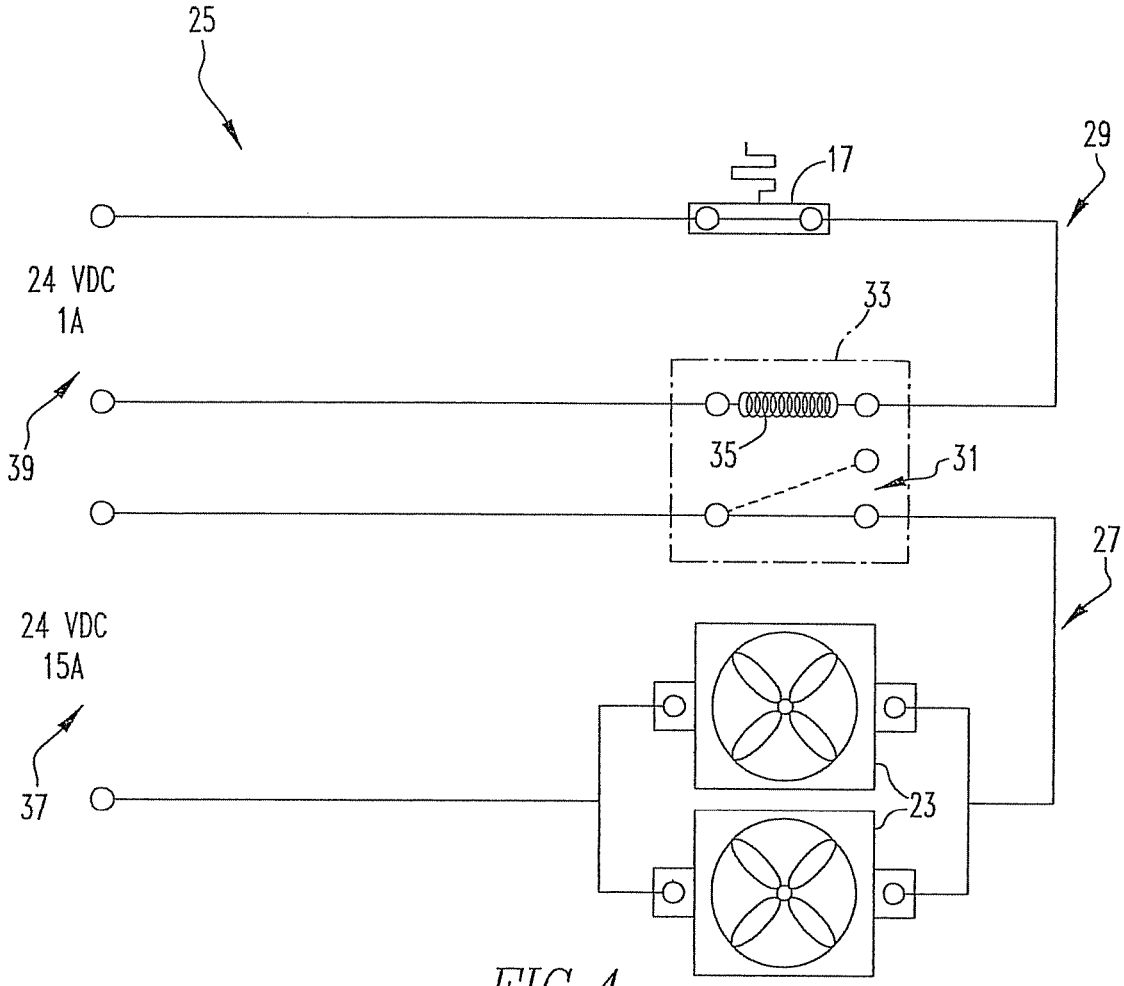
FIG. 4 is a schematic diagram of the temperature management system.

With reference to FIG. 4, and with continuing reference to FIGS. 1 through 3, a schematic diagram of the temperature management system, denoted generally as reference numeral 25, is illustrated. Temperature management system includes a load circuit 27 and a switching circuit 29. Load circuit 27 includes the pair of cooling fans 23 electrically coupled in parallel, and contacts 31 of an electrical relay 33 located in a series between the pair of cooling fans 23 and an electrical power supply. Switching circuit 29 includes temperature switch 17 and a coil 35 of electrical relay 33 provided in a series with temperature switch 17. The electrical power supply supplies 24 VDC. A 15 A fused line 37 is provided to power load circuit 27, and a 1 A fused line 39 is provided to power switching circuit 29.

The operation of temperature management system 25 is as follows. When air temperatures at high pressure stage inlet 19 are below approximately 200° F., temperature switch 17 is closed. This position holds the normally closed electrical relay 33 in the energized (open) position (shown in phantom in FIG. 4). In this state, cooling fans 23 are off. When the temperature at high pressure stage inlet 19 rises above 200° F., temperature switch 17 is configured to open, thereby causing coil 35 of electrical relay 33 to de-energize. When coil 35 de-energizes, contacts 31 of the electrical relay 33 close, thereby applying power to the pair of cooling fans 23 causing them to start. Fans 23 will run until the air temperature at high pressure stage inlet 19 falls below approximately 190° F. At that air temperature, temperature switch 17 closes, thereby energizing coil 35 of electrical relay 33 and opening contacts 31. This turns off cooling fans 23. Failure of temperature switch 17 causes contacts 31 of electrical relay 33 to close which applies power to the parallel cooling fans 23. Accordingly, temperature management system 25 is failsafe. If temperature switch 17 fails or is not powered, fans 23 will turn on as long as power is supplied to load circuit 27 via the normally closed electrical relay 33.

Temperature management system 25 provides air compressor 1 with various advantages over existing compressors. Cooling fans 23 provide air compressor 1 with an integral source of cooling air that previously was completely supplied by external means via a radiator or other cooling fan on board the locomotive. Accordingly, air compressor 1 with temperature management system 25 does not need to be mounted directly in the proximity of the radiator or other cooling fans of the locomotive. It may be mounted at any suitable location on the locomotive. For example, compressor 1 may be mounted in a rear compartment of the locomotive with the compressor axis mounted in any orientation. In other words, the axis of the compressor shaft may be placed perpendicular to the direction of travel of the locomotive. Compressor 1 may also be placed on an elevated platform above the locomotive deck or to one side of the locomotive longitudinal axis to allow room for other auxiliary equipment. Accordingly, in many ambient conditions, it is possible that no external cooling fans will be required for the purpose of providing cooling air to air compressor 1.

In addition, due to the operating nature of a multiple stage compressor with inter-stage cooling, the internal temperatures of the compressor must be held high enough to avoid the internal condensation of water. However, too little cooling will cause the compressor to be less efficient and in extreme cases, will lead to compressor failure. In order to maintain a proper operating temperature, prior art 2CD type compressors are typically located directly beneath the locomotive radiator for overheating protection and minimum compressor operating temperatures are maintained by never turning the compressor off when in use. Such compressors were operated in a load/unload method of operation instead of a start/stop method of operation. By providing air compressor 1 with pair of cooling fans 23 that can be controlled to provide the necessary amount of cooling or to provide no cooling, air compressor 1 with temperature management system 25 can quickly achieve minimum operating temperatures and at the same time be protected from exceeding maximum operating temperatures. This advantage allows air compressor 1 to be mounted away from external cooling sources and be operated in a start/stop method.

Furthermore, as a direct result of the requirement to always spin the compressor when in operation, methods to drive the compressor are limited. It has become standard design procedure to mount the compressor directly inline with the locomotive crankshaft via a coupling. In this configuration, the prior art compressor was always turning when the locomotive engine was running. However, this forces the locomotive builder to place the compressor inline with the engine and turn the compressor at the engine speed of the locomotive. Another option was to mount the compressor perpendicular to the locomotive driveshaft and gear down the compressor speed using a belt or gear box type drive. Temperature management system 25, by allowing stop/start operation of air compressor 1, allows air compressor 1 to be driven by an electric motor operatively coupled to drive pulley 15 of air compressor 1. This provides the locomotive designer with great flexibility in locating air compressor 1. Air compressor 1 with temperature management system 25 does not need to be positioned inline or perpendicular to the locomotive driveshaft and in most cases does not require direct cooling air from an external source. Accordingly, air compressor 1 with temperature management system 25 can be positioned in any suitable location on the locomotive.

Finally, there is significant power savings by driving air compressor 1 using an electric motor in a stop/start type operation as opposed to running the compressor at all times. However, driving air compressor 1 with an electric motor also allows the compressed air delivery to meet the compressed air demand by varying the speed of the electric motor independently of the locomotive engine speed. Since air delivery is proportional to compressor rotational speed, the air delivery can meet the exact air demand without wasting unnecessary power.

Although the invention has been described in detail by illustrative embodiments, it is to be understood that such detail is solely for that purpose and that the invention is not limited to the disclosed embodiments, but, on the contrary, is intended to cover modifications and equivalent arrangements. For example, it is to be understood that the present invention contemplates that, to the extent possible, one or more features of any embodiment can be combined with one or more features of any other embodiment.

The invention claimed is:

1. A temperature management system for an air compressor comprising:

a plurality of cooling fans coupled to an intercooler of the air compressor;

an electrical relay comprising a coil and contacts operated by the coil, the contacts located in series between the cooling fans and an electrical power supply; and a temperature switch coupled in series to the coil of the electrical relay, wherein the temperature switch opens at a temperature above a predetermined temperature at a high pressure inlet of a high pressure stage of the air compressor, thereby closing the contacts of the electrical relay which applies power to the cooling fans, and the intercooler is configured to cool air between the lower pressure stage and the high pressure stage of the compressor.

2. The temperature management system of claim 1, wherein the cooling fans comprise a first cooling fan and a second cooling fan.

3. The temperature management system of claim 2, wherein the first cooling fan and the second cooling fan are electrically coupled in parallel.

4. The temperature management system of claim 1, wherein the predetermined temperature is about 200° F.

5. The temperature management system of claim 1, wherein the air compressor is a 2CD type air compressor.

6. The temperature management system of claim 1, wherein the temperature switch is closed when the temperature at the high pressure inlet falls below a second predetermined temperature, thereby opening the contacts of the electrical relay and removing power supplied to the cooling fans.

7. The temperature management system of claim 6, wherein the second predetermined temperature is about 190° F.

8. The temperature management system of claim 1, wherein the temperature switch is positioned at the high pressure inlet of the high pressure stage of the inlet.

9. The temperature management system of claim 1, wherein failure of the temperature switch causes the contacts of the relay to close, thereby applying power to the cooling fans.

10. An electrical circuit for controlling a plurality of cooling fans coupled to an intercooler of an air compressor, the electrical circuit comprising:

a load circuit comprising:

the plurality of cooling fans; and contacts of an electrical relay located in series between the cooling fans and an electrical power supply; and a switching circuit comprising:

a temperature switch; and a coil of the electrical relay coupled in series with the temperature switch, wherein the temperature switch opens at a predetermined temperature at a high pressure inlet of a high pressure stage of the air compressor, thereby closing the contacts of the electrical relay which applies power to the cooling fans, and the intercooler is configured to cool air between the lower pressure stage and the high pressure stage of the compressor.

11. The electrical circuit of claim 10, wherein the cooling fans comprise a first cooling fan and a second cooling fan.

12. The electrical circuit of claim 11, wherein the first cooling fan and the second cooling fan are electrically coupled in parallel.

13. The electrical circuit of claim 10, wherein the predetermined temperature is about 200° F.

14. The electrical circuit of claim 10, wherein the air compressor is a 2CD type air compressor.

15. A method of installing an air compressor on a locomotive, the method comprising the steps of:

providing an air compressor having a temperature management system, the temperature management system comprising:

a plurality of cooling fans coupled to an intercooler of the air compressor;

an electrical relay comprising a coil and contacts operated by the coil, the contacts located in series between the cooling fans and an electrical power supply; and a temperature switch coupled in series with the coil of the electrical relay; and mounting the air compressor with the temperature management system at a location remote from a radiator of the locomotive, wherein the temperature switch opens at a temperature above a predetermined temperature, thereby closing the contacts of the electrical relay which applies power to the cooling fans, and the intercooler is configured to cool air between the lower pressure stage and the high pressure stage of the compressor.

16. The method of claim 15, wherein the temperature switch is closed when the temperature at the high pressure inlet falls below a second predetermined temperature, thereby opening the contacts of the electrical relay and removing power supplied to the parallel first cooling fan and second cooling fan.

17. The method of claim 16, wherein the predetermined temperature is about 200° F., and the second predetermined temperature is about 190° F.

18. The method of claim 15, wherein failure of the temperature switch causes the contacts of the relay to close, thereby applying power to the cooling fans.

* * * * *